United States Patent [19]

Finke

[11] 4,449,922

[45] May 22, 1984

[54] REHEAT FURNACE DROP OUT DOOR SEAL

[75] Inventor: Harry P. Finke, Pittsburgh, Pa.

[73] Assignee: Bloom Engineering Company, Inc., Pittsburgh, Pa.

[21] Appl. No.: 412,777

[22] Filed: Aug. 30, 1982

[51] Int. Cl.[3] ..... F24F 9/00; F23M 11/02; F27D 1/18

[52] U.S. Cl. ..... 432/64; 110/179; 432/250

[58] Field of Search ..... 432/64, 250, 239; 110/179, 173

[56] References Cited

U.S. PATENT DOCUMENTS

| | | | |
|---|---|---|---|
| 713,288 | 11/1902 | Cummings | 432/64 |
| 1,803,032 | 4/1931 | Nagel | 432/64 |
| 1,881,536 | 10/1932 | Harmon | 432/239 |
| 1,937,812 | 12/1933 | Culbertson | 432/64 |
| 2,167,047 | 7/1939 | Jackson et al. | 110/179 |

*Primary Examiner*—John J. Camby

*Attorney, Agent, or Firm*—Webb, Burden, Robinson & Webb

[57] ABSTRACT

A discharge door assembly for a reheat pusher furnace having a drop out slope includes a refractory lined main frame, a hood extending out from the main frame, a fluid plenum extending substantially the length of the door beneath the hood and a plurality of fluid jets spaced along and extending from the plenum to direct a stream of fluid such as air parallel or convergent with the drop out slope.

7 Claims, 4 Drawing Figures

REHEAT FURNACE DROP OUT DOOR SEAL

FIELD OF THE INVENTION

My invention relates to reheat furnaces and more particularly to reheat furnaces having a drop out slope for discharging product from the furnace hearth line to a subsequent processing line external of the furnace.

DESCRIPTION OF THE PRIOR ART

A substantial number of reheat furnaces include a drop out slope at the discharge end of the furnace, which slope is used to gravity feed slabs and the like from the hearth line of the furnace to a subsequent processing line external of the furnace. Presently, there are no discharge doors known to applicant that will effectively maintain a seal between the drop out slope and the furnace door to eliminate air infiltration caused by the natural draft between the roll line and the hearth line resulting from the drop out slope being heated by radiation. Attempts to solve this problem have included the utilization of a row of screen burners operating substoichiometrically to consume the air drawn into the furnace under the door. Such a row of screen burners has been effective only through narrow ranges of operation.

Air curtains in general have been used to create seals through the formation of a pressure barrier on soaking pit covers.

SUMMARY OF THE INVENTION

My invention eliminates the air infiltration associated with discharge doors and drop out slopes of reheat furnaces. This is accomplished by using a high velocity stream of fluid such as air which creates a draft down the slope from the furnace which then counterbalances the draft formed between the roll line and the hearth line.

I provide a discharge door assembly which includes a refractory lined main frame, a hood extending out from the main frame, an air plenum extending the length of the door beneath the hood and a plurality of air jets spaced along and extending from the air plenum to direct a stream of air through the partially enclosed spaced formed by the hood and substantially parallel with the drop out slope. Fluids other than air, an elongated slot instead of a plurality of jets and a converging stream of air rather than a substantially parallel stream may be employed.

DESCRIPTION OF THE PREFERRED EMBODIMENTS

Figure 1:
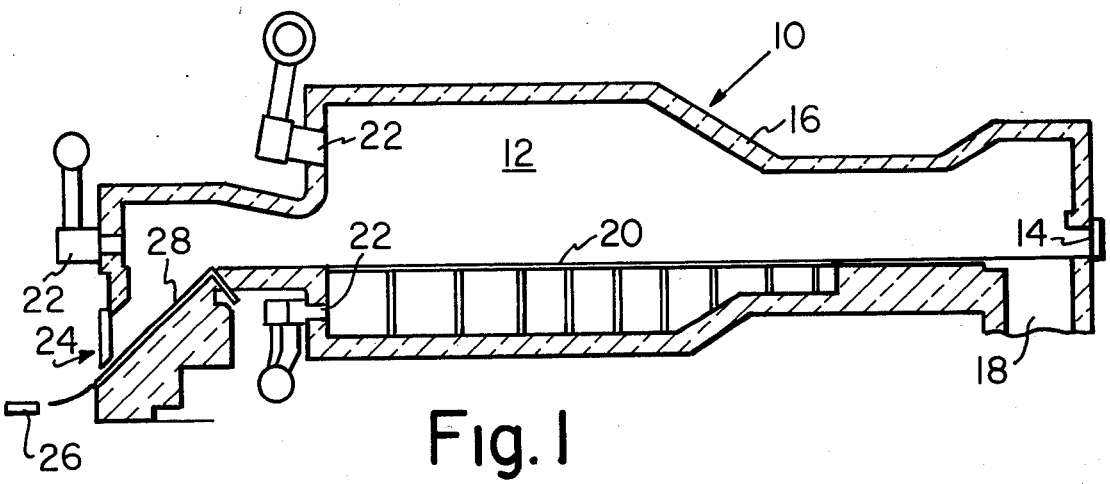
FIG. 1 is a section through a pusher reheat furnace.

A pusher type reheat furnace generally designated 10 of the type use to preheat slabs prior to rolling is illustrated in FIG. 1. The reheat pusher furnace 10 includes a superstructure (not shown) and a refractory lining 16 which defines the furnace chamber 12. Product such as slabs, blooms or billets enters the furnace chamber 12 through a charging door 14 and the product passes along a hearth line 20 in side by side abutting relationship. A series of burners 22 are positioned at different locations in the furnace 10 to approximately treat the product in the furnace chamber 12. The product exits the furnace chamber 12 through a gravity feed formed by a drop out slope 28 which extends from the hearth line 20 within the furnace chamber 12 to a conveyor external of the furnace such as roller line 26. Other types of reheat furnaces include a gravity feed drop out slope. For example walking beam furnaces may include this feature.

The discharge door 24 is normally pivotally mounted to the rear wall of the furnace chamber and is adapted to be swung outwardly so as to permit the product that has been heated to discharge from the furnace along the drop out slope. The door 24 is normally adapted to be opened by appropriate fluid cylinders, cables and counterweights, the details of which do not form a part of the subject invention.

Figure 2:
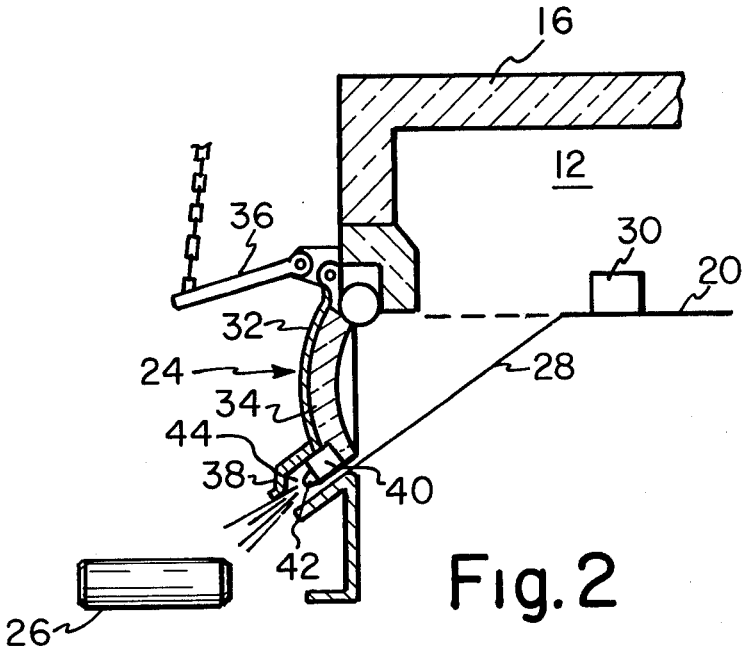
FIG. 2 is a section through the discharge door assembly of my invention.

The details of my discharge door assembly are illustrated in FIG. 2. The discharge door 24 includes a steel main frame 32 which is pivotally connected to the external face of the furnace end wall and is operable by appropriate levers and cables 36. Steel frame 32 has secured to it a refractory lining 34 facing the inside of furnace chamber 12. Extending outward from the distal end of the steel frame 32 is a hood 38 which extends along the width of the door. Inward and rearward (toward the furnace interior) of the hood 38 is an air plenum 40 also extending the length of the furnace door. While air is the most common fluid, other fluids such as steam or other gases may be readily available at a particular furnace site and may be used in place of air. A space 44 is created between the air plenum 40 and the forward end of the hood 38. A plurality of nozzles 42 extend in spaced relationship from the air plenum 40 across the width of the furnace door. The nozzles 42 are at an elevation below the hearth line 20. The nozzles 42 are directed so as to direct a high velocity air stream in parallel relationship to and downwardly along the drop out slope 28.

These nozzles may also extend from the bottom of the air plenum and include a 90° turn to accomplish the parallel air stream. While the parallel stream provides the optimum seal, an air stream which converges into the drop out slope may also be employed. The greater the angle of convergence, the smaller the parallel air stream vector and therefore the lesser the positive seal effect. The term "substantially parallel" as used herein means that there is a substantial air stream vector in parallel relationship to the drop out slope.

Figure 3:
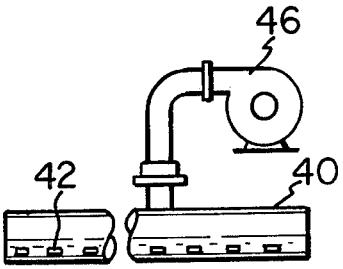
FIG. 3 is a broken-away front view of the air plenum with nozzles.

Air is supplied to the air plenum 40 by an appropriate blower 46 (see FIG. 3). The nozzles 42 and air plenum 40 provide an air curtain to prevent air from passing into the furnace from the outside through the gap formed between the bottom of the furnace door and the drop out slope 28. In addition, the stream of air has sufficient velocity to create a partial vacuum under the hood 38 and in the space 44, which partial vacuum creates a natural draft down the drop out slope from the furnace, counterbalancing the natural draft created between the roll line and the hearth line.

Figure 4:
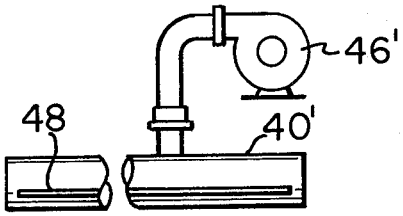
FIG. 4 is a broken-away front view of an air plenum with a continuous slot.

An alternative embodiment of my invention is illustrated in FIG. 4 where the air plenum 40' is connected to a blower 46' as in the earlier embodiment. However, instead of a plurality of nozzles as in the earlier embodiment, a continuous slot 48 is provided, which slot 48 directs the stream of air in substantially the same manner as the earlier embodiment.

While the presently preferred embodiment of my invention has been illustrated and described, it may otherwise be embodied within the scope of the appended claims.

I claim:

1. In a reheat furnace having a furnace exit door, a drop out slope extending from a hearth line inward of the door and internal of the furnace extending to a passline external of said door and furnace, the improvement comprising fluid curtain means connected to the door at substantially a bottom end thereof and exiting at an elevation below the hearth line and directed along the drop out slope and away from the furnace to prevent air from entering the furnace along the drop out slope in the area of the door.

2. The improvement of claim 1, said fluid being air.

3. The improvement of claim 1, said fluid curtain means including an air plenum extending substantially the furnace door length.

4. The improvement of claim 3, including a plurality of air jets extending from the air plenum to direct an air stream substantially parallel with the drop out slope when the furnace door is closed.

5. The improvement of claim 3, including a continuous slot extending from the air plenum to direct an air stream substantially parallel with the drop out slope when the furnace door is closed.

6. The improvement of claim 3, including a hood extending outward of the door along the plenum to create a continuous space between the hood and the plenum.

7. In a reheat pusher furnace having a hearth line internal of the furnace and a drop out slope extending from the hearth line to a roll line external of the furnace, the improvement comprising a discharge door assembly including:

A. a refractory lined main frame;

B. a hood extending out from the main frame to create a closed in space between the door and hood;

C. an air plenum extending substantially the length of the door in the area of a door bottom; and D. a plurality of air jets spaced along and extending from the air plenum and directed to fire a stream of air at an elevation below the hearth line along the closed in space and substantially parallel with the drop out slope, whereby a vacuum is created in said closed in space which creates a draw down the slope preventing air from passing into the furnace beneath the door assembly.

* * * * *